US010131496B2

(12) United States Patent
Matias

(10) Patent No.: US 10,131,496 B2
(45) Date of Patent: Nov. 20, 2018

(54) MODIFIED END FACE PANEL FOR A FLEXIBLE INSERT FOR A CONTAINER AND TENSIONING METHOD

(71) Applicant: Carlos Jose Duarte Matias, Lisbon (PT)

(72) Inventor: Carlos Jose Duarte Matias, Lisbon (PT)

( * ) Notice: Subject to any disclaimer, the term of this patent is extended or adjusted under 35 U.S.C. 154(b) by 0 days.

(21) Appl. No.: 15/323,167

(22) PCT Filed: Jun. 30, 2015

(86) PCT No.: PCT/US2015/038463

§ 371 (c)(1),
(2) Date: Dec. 30, 2016

(87) PCT Pub. No.: WO2016/003989

PCT Pub. Date: Jan. 7, 2016

(65) Prior Publication Data

US 2017/0137215 A1 May 18, 2017

Related U.S. Application Data

(60) Provisional application No. 62/019,657, filed on Jul. 1, 2014.

(51) Int. Cl.
*B65D 90/04* (2006.01)

(52) U.S. Cl.
CPC ..... *B65D 90/048* (2013.01); *B65D 90/046* (2013.01); *B65D 2590/046* (2013.01)

(58) Field of Classification Search
CPC ..... B65D 90/02–90/048; B65D 88/00–88/78; B65D 90/00; B65D 2590/00
(Continued)

(56) References Cited

U.S. PATENT DOCUMENTS 4,601,405 A 7/1986 Riemer
5,551,379 A * 9/1996 Hart ..... A01K 27/003 119/771

(Continued)

FOREIGN PATENT DOCUMENTS

DE 103 30 504 A1 2/2005

OTHER PUBLICATIONS

International Search Report (WO 2016/003989 A3 published Jan. 7, 2016, for application No. PCT/US2015/038463, 4 pages.

(Continued)

*Primary Examiner* — Kareen Thomas
(74) *Attorney, Agent, or Firm* — Ware, Fressola, Maguire & Barber LLP

(57) ABSTRACT

Safe transport of bulk materials is assured by a lashing system that suspends a flexible end face panel adjacent to rear doors of a shipping container, and that restrains the end face panel during loading and subsequent transport, so that the adjacent container door may be opened and closed without difficulty. The lashing may for instance be done by threading a strap through a ring in a central part of the panel and several cargo rings in the corners of a door opening of the container, and after tightening the strap, the strap is secured by passing a clasp through two holes in the strap that are aligned when under the desired tension. A triangular shaped strap may be sewn into the panel with a ring at the apex as an embodiment.

12 Claims, 3 Drawing Sheets

(58) Field of Classification Search
USPC ..... 220/729, 495.01–495.11
See application file for complete search history.

(56) References Cited

U.S. PATENT DOCUMENTS

| | | | | |
|---|---|---|---|---|
| 5,657,896 | A * | 8/1997 | Matias | B65D 90/048 220/1.6 |
| 5,667,002 | A * | 9/1997 | Neustadt | B65D 88/14 160/368.1 |
| 8,695,824 | B2 * | 4/2014 | Cavenagh | B65D 88/1612 220/475 |
| 2003/0047561 | A1 | 3/2003 | Neto | |

OTHER PUBLICATIONS

Written Opinion of the International Search Authority dated Jan. 14, 2016, for application No. PCT/US2015/038463, 6 pages.

* cited by examiner

MODIFIED END FACE PANEL FOR A FLEXIBLE INSERT FOR A CONTAINER AND TENSIONING METHOD

CROSS REFERENCE TO RELATED APPLICATIONS

This application claims priority in U.S. Provisional Patent application No. 62/019,657, filed Jul. 1, 2014.

TECHNICAL FIELD

This invention relates to a modified end face panel for a flexible insert, also called a liner that is used in a bulk material shipping container, transported in vessels, trucks, trains, etc. The containers are generally rectangular and of standard size for ease in loading, stacking and transporting. Flexible liners are often installed which conform to the container shape, for holding the bulk cargo therein. Some shipping containers may not be completely lined, but rather have partial liner portions installed. For example, an end face/back flexible liner panel may be placed adjacent the container rear door prior to filling. This allows the rear door to be opened without the bulk contents flowing out, so the cargo can be inspected.

BACKGROUND

The use of a flexible liner in standard international container is well known. These liners are inserted within the generally rectangular container and substantially conform to the shape of the rectangular container. These liners can be manufactured using a wide variety of materials including for example polyethylene or polypropylene, and can be made with blown film or woven fabric, both coated and uncoated, as well as possibly including reinforcement, depending on the application. For example, some liners are more abrasion resistant, others more corrosion resistant, while others provide a moisture barrier, etc. These liners substantially cover the inside of the container which then receives a bulk material, the liner preventing the bulk material from contacting the container walls or floor.

In other cases, it is only necessary to include an end face panel, which is provided as a standalone end face panel to prevent the bulk cargo from being discharged when the rear container doors are opened. Another form of flexible insert consists essentially of a flexible end door portion having upper suspension elements such as flexible straps constructed and arranged for suspension from cooperating suspension elements such as cargo rings or attachment straps, fixed to the upper part of a container, a transverse reinforcement constructed and arranged to receive nails or screws or other attachment devices for securing the bottom of the flexible end door portion to the rear end of the floor wall of the container. These end panels may have reinforcing straps interconnecting the flexible rear door portion to a part of the floor and/or walls of the container so that when the container is filled with cargo and the flexible end door portion of the insert is lifted, the reinforcing straps become taut to counteract a tendency for the flexible end door portion to bulge outward. This is typically used in situations where the materials do not harm the walls of the container, or the walls do not contaminate the material, or both.

Some container liners of the prior art have used metal bars positioned across the end face or back panel, which reside in channel edges of the container door to secure the liner. Some other container liners rely on various strap configurations which are attached to the container and extend across the flexible back panel to hold the back panel in position so that it does not bulge out when the container doors are opened.

Care must be taken to insure that the end face or back panel does not move within the container, because relative movement may tear the flexible liner material and cause the contents to spill. Unless steps are taken to maintain the rear end wall in close relation to the corresponding rear end wall of the container, problems arise. Thus, a flexible container liner of the prior art may, even after being secured within the container, have its end panel, which corresponds to the doors of the shipping container, bulge out outwardly into the doorway opening of the container, as filling of the container with bulk product occurs. The bulging may obstruct the closing of the doors of the container. Also bulk cargos have a tendency to move during shipment and this could cause the back panel to bulge outwardly after loading, which could result in a forcible opening of the back doors, which can cause worker injury. This potential for outward bulging can be a problem with containers when opened for inspection before reaching their final destination, as the bulging out can prevent the doors of the container from being reclosed.

While there have been a number of attempts made to address the problem, particularly as to the bulging of the end panel, many of these attempts have suffered from various problems or are difficult or inconvenient to implement. For example, in U.S. Pat. No. 6,662,962, a plurality of straps must be provided and arranged and then free ends of several straps engaged by removable manual tensioning ratchet devices which require significant manual labor to set up and to tension the straps, delaying the loading process, and this manual tensioning can lead to variable strap tension and possibly still result in bulging of the end panel.

A problem with the prior art strap configurations is that they are often difficult and complicated to install. Additionally, restraining the end panel from bulging with multiple straps takes substantial installation time, and often provides variable tension because it requires manually tightening of the straps, which may or may not be sufficient to prevent bulging. Unfortunately, this can only be discovered after the container is filled, when it is too late to take any corrective action.

DISCLOSURE OF INVENTION

An object of this invention is to create a modified end panel for a flexible liner which is resistant to bulging, and which does not rely on manual tensioning, but enables quick tensioning and locking of restraining straps. The applicant's invention overcomes the deficiencies of the prior art, by allowing mechanical means to quickly and strongly secure and tension a single strap, which can be easily locked into position, substantially reducing the time it takes to secure the end panel so that loading can commence, while also assuring that the maximum tensioning is achieved.

Another object is to provide an easier way to assemble and tighten the end panel of a flexible liner, in particular, to assemble and tension the end panel restraining straps without the use of a manual tensioning device.

The objects of the invention are achieved, according to a first aspect of the present invention, by a modified end panel comprising an end panel for insertion in a shipping container in a door opening of the shipping container, and a pull ring attached to the end panel positioned as a central pull ring that when pulled by tensioning straps causes the end panel to push back against any bulging of the end panel by cargo loaded into the container abutting the end panel and pushing against the end panel from inside the container.

The modified end panel may be either a standalone end panel or an end panel of a flexible liner or insert and may be used to minimize outward bulging adjacent a container end door when the container is filled with a bulk cargo. Alternatively, according to a second aspect, it may comprise an end panel and a strap sewn or otherwise attached to at least a first bottom corner of the end panel of the flexible liner or insert and extending or at least extendable from a the first bottom corner of the end panel diagonally up to a middle area of the end panel and down to a second bottom corner where the strap is sewn or otherwise attached to at least the second bottom corner, forming a triangle with an unsewn or unattached top apex forming an opening that acts as a central ring.

The strap is preferably partially sewn or affixed at least to the bottom corners of the end panel of the insert, extending preferably diagonally up to a middle area of the insert middle portion and down to the opposite bottom corner, forming a triangle with its top apex preferably loose to form an opening that acts as a central ring. The strap may be sewn or otherwise attached from the corners up to the apex area where the apex is left unsewn or unattached so as to form a threadable ring.

The improved end panel according to the first and second aspects of the invention may further comprise:

a single strap having a first end lockable to a first upper corner ring, extendable diagonally downwardly through the central ring, then diagonally upwardly to an opposite side second upper corner ring, passable therethrough and diagonally downwardly through the central ring and diagonally upwardly through the first upper corner ring, then diagonally downwardly through the central ring and further downwardly through a bottom corner ring with a second end of the strap passable therethrough and being engageable by a mechanical tensioning device, wherein the portions of the single strap which pass upwardly and downwardly relative to the first upper corner ring have engagement means, in one embodiment being a plurality of linearly arranged openings, such that once the strap is tensioned by the mechanical tensioning device, a locking device is passable through at least one facing pair of openings, for maintaining the strap in the tensioned condition, after the mechanical tensioning device is removed.

In another embodiment of the invention, the single strap, in the final leg passes instead of through the central ring, straight downwardly through the bottom ring located below the first upper corner ring, then back upwardly through the first upper ring, the free end then engaged by the mechanical tensioning means, the facing portions on the strap passing between the first upper corned ring and bottom corner ring having the engagement means which are in one embodiment the plurality of facing holes so as to permit locking of the strap, after tensioning along the side, rather than in the middle, of the end panel.

According to a third aspect of the invention, a method is provided, comprising:

firstly, extending a strap locked to a first corner cargo ring of a container in a first diagonal direction to a ring centrally positioned in a door opening of the container and threading the strap through the central ring, secondly, extending the strap in a second diagonal direction to a second corner cargo ring of the container and threading the strap through the second corner cargo ring, thirdly, extending the strap in a direction opposite to the second diagonal direction to the central ring and threading the strap through the central ring, fourthly, extending the strap in a direction opposite to the first diagonal direction to the first corner ring and threading the strap through the first corner ring, and either:

(1) fifthly, extending the strap in the first diagonal direction to the central ring, threading the strap through the central ring, further extending the strap in the first diagonal direction to a third corner cargo ring, and threading the strap through the third corner cargo ring, and pulling on the strap threaded through the third corner cargo ring to a selected tension and then fixing the selected tension by locking the strap in place with a locking device that locks one diagonally extended part of the strap to a facing diagonally extended part of the strap, or (2) fifthly extending the strap in a vertical direction to a third corner cargo ring, threading the strap through the third corner cargo ring, extending the strap in an opposite vertical direction to the first corner cargo ring, threading the strap through the first corner cargo ring, and pulling on the strap threaded through the first corner cargo ring to a selected tension and then fixing the selected tension by locking the strap in place with a locking device that locks one vertically extended part of the strap to a facing vertically extended part of the strap.

The pulling is preferably carried out by a powered machine such as a fork lift, but may be carried out by other means such as by a hand operated winch with a ratchet, or simply by pulling by manpower.

The central ring may be attached to an end panel of a flexible liner or insert for the container and the selected tension minimizes outward bulging adjacent the door opening of the container when the container is filed with a bulk cargo.

The strap may be provided with holes at intervals along selected portions of the strap that face one another after the pulling to the selected tension and the locking comprises clasping two facing holes together with a clasp metallic ring, strap ring, or chain.

According to a fourth aspect of the present invention, a method comprises threading a loose extension of a strap attached to a panel from a corner of the panel through a first corner cargo ring of a container in a first diagonal direction to a ring centrally positioned in the panel and threading the extension of the strap through the central ring, extending the strap in a second diagonal direction to a second corner cargo ring of the container and threading the strap through the second corner cargo ring, extending the strap in a direction opposite to the second diagonal direction to the central ring and threading the strap through the central ring, and extending the strap in a direction opposite to the first diagonal direction toward the first corner ring and fastening the strap extension under tension between the first corner cargo ring and the central ring.

This invention thus provides a flexible modified end face panel for use as a standalone end panel or as an end panel of a flexible insert or liner that approximates the shape of an end face of a cargo container, so that the flexible end face panel is positionable parallel to the rear doors without bulging into and thereby preventing the doors from closing. The invention provides for the safe transport of most bulk materials through a lashing system that suspends the flexible end face panel adjacent to the rear doors of the container, and restrains the end face panel during loading and subsequent transport, so that the adjacent container door may be opened and closed without difficulty. A standalone modified end panel or a flexible insert having a modified end panel according of to this invention is characterized by a flexible end door portion that is reinforced by extending a strap that connects the end panel to at least one of the walls of the container and which may be made consistently taut using mechanical tensioning devices, so that the container can be loaded with cargo and the rear end doors opened.

Other variations on the above are possible, as would be understood by one skilled in the art and those variations are within the spirit and scope of the invention.

DETAILED DESCRIPTION OF EMBODIMENTS

The term "container" will be used hereinafter to include standard transport containers, cargo vessels and cargo storage space, and "bulk material" includes, but is not limited to, large quantities of materials which may be solids in the form of powder, pellets, flakes or granules, and liquids. Examples of bulk material include coffee beans, salt, grains and the like.

Figure 1:
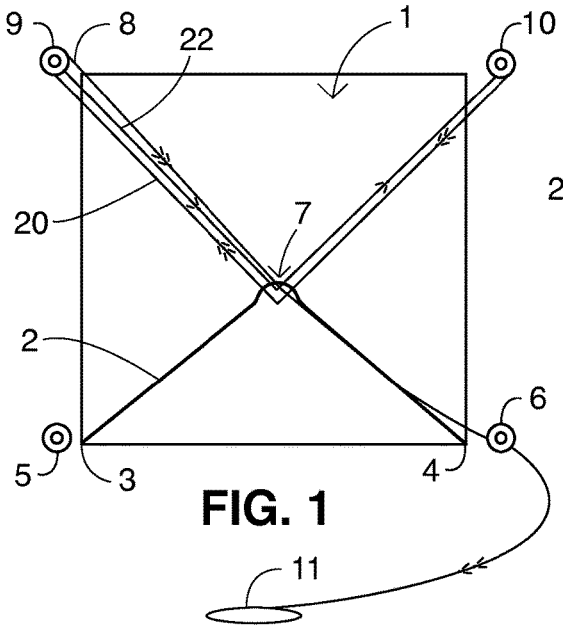
FIG. 1 shows a first embodiment of an improved end panel, according to the present invention, and a method of using the improved end panel.

Referring to FIG. 1, an end panel 1 of a flexible liner (not shown for ease in illustration only) is shown. The end panel itself is made of a flexible material and is integral with the container liner or may be integral with the container, and located adjacent to the rear doors of the container, also not shown for ease in illustration. In this embodiment, a lower strap is fixed at least at the two lower corners of the panel. It may be affixed to the panel by any means such sewn to the panel. The lower strap 2 has ends 3 and 4 that may use metal hooks or strap knots to connect to two bottom cargo rings 5 and 6, with sufficient slack in the strap to form a triangle with an apex at around a middle height of the end panel. The top apex portion of the triangle when formed will be loose at this point, to allow the apex to function as a central ring 7 engaged by another strap as described below. The lower strap 2 may be sewn or otherwise affixed to the panel extending up from the lower corners to near the apex where it remains unsewn so as to leave the apex loose. Or it may be sewn or otherwise affixed only at the two lower corners. In another embodiment described below there is no lower strap used at all but only a central ring that is not attached to a panel or that is attached to an improved panel in a central part thereof.

Referring still to FIG. 1, a separate strap 8 has an end connected by a hook, clasp, or other attachment means to a first top ring 9, with a free end 11 wound through the central ring 7 and a second upper ring 10 following the illustrated arrows. Thus, the strap is wound from ring 9, through central ring 7, through ring 10, back down through the central ring 7, up to the first ring 9, then in a final leg down through the central ring, to the bottom ring 6, with the free end 11 then engaged by mechanical means such as a fork truck, which applies tension to the strap.

Figure 2:
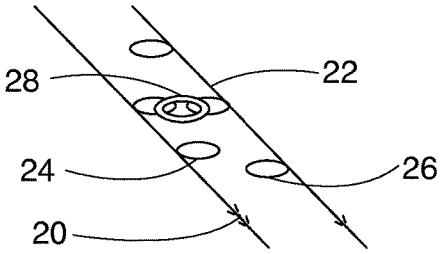
FIG. 2 shows a locking system, according to an embodiment.

Referring to FIG. 2, the locking system is shown. The facing portions of the strap constituting the upward strap portion 20 heading to the first ring 9, and the downward portion 22 heading to the bottom ring 6 each have a plurality of linearly spaced rings or openings 24, 26 facing each other in between the first ring 9 and the central ring 7. After tensioning, a strap, ring, clasp, or other locking device 28 is passed through at least one pair of aligned openings, so as to maintain the tension achieved by the mechanical tensioning device, which can then be disconnected.

In this way, the installation and tensioning can be rapidly completed and also the amount of tension can be rapidly achieved and of a sufficient strength to assure that no bulging will occur. Consistency in tensioning can be confirmed with appropriate marking to be sure that the same holes are aligned each time that tensioning occurs. Thus, the straps extend to be taut when the insert is loaded to resist outward bulging of the end door portion. Metal chains or linkages that collapse when folded and extend to be taut when stretched are included in the term "straps" within the meaning of embodiments of this invention that include oblique reinforcing straps.

Thus, it will be understood that the central ring is strongly attached in such a way that it may be pulled by tensioning a strap without detaching from the panel. As such it may be referred to as a "pull ring" meaning that it may be subjected to tensioning forces by the strap threaded through the pull ring. The strap may be strongly tensioned for instance by a machine to exert strong pulling forces from the corners of the container. These forces act at least in part to cause the panel to restrain pushing forces against the panel exerted by the cargo from inside the shipping container. A modified end panel is thus provided that includes an end panel for insertion in a shipping container in a door opening of the shipping container and a pull ring attached to the end panel positioned as a central pull ring that when pulled by tensioning straps acts to cause push back against and restraint of bulging of the end panel by cargo in the container abutting the end panel and pushing against the end panel from inside the container to cause the bulging. Among other benefits, the restraint of the bulging by action of the tensioning straps is sufficient to allow reclosing an end door of the container after opening the door, e.g., for inspection.

Figure 3:
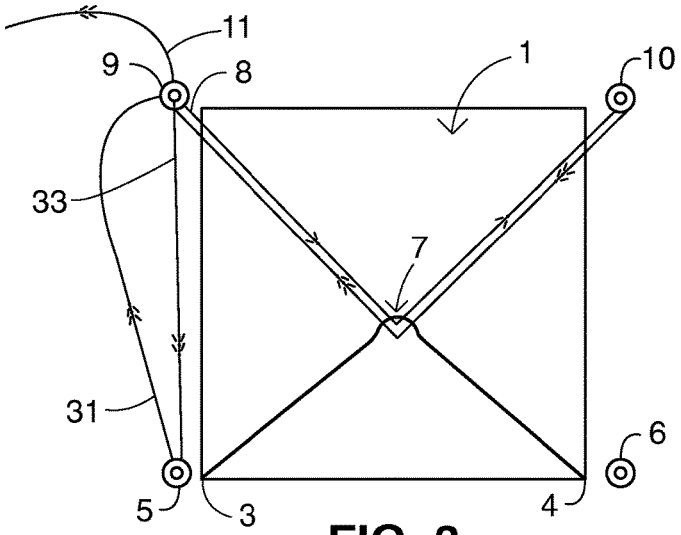
FIG. 3 shows a second embodiment of an improved end panel, according to the present invention, and a method of using the improved end panel.
Figure 4:
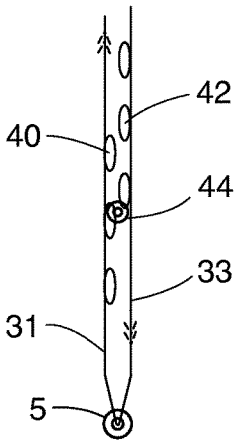
FIG. 4, a locking system according to the second embodiment.

Referring to FIG. 3, an alternative embodiment is shown where the final leg, instead of passing through the central ring 7, proceeds 33 downwardly through the bottom ring 5, then upwardly 31 through the upper ring 9, with the free end 11 passed on to the tensioning device. As shown in FIG. 4, the portions of the strap passing down 33 then up 31 include the plurality of alignable rings or openings 42, 40 so that the locking with a metallic ring or clasp or a strap 44 can take place along the side of the end panel, rather than in the center of the panel.

As an alternative to using mechanical tensioning means, it is possible that the final tightening can be achieved by people pulling on the free end while another person monitors the hole alignment and then locks the strap in position, if a forklift truck is not available, or the strap can be attached to a come-along or ratcheting device for tensioning, or even if hooked to one of the doors to use it to facilitate pushing the strap out and consequently to tighten it. By utilizing the hole alignment, a more consistent tensioning of the end panel is achieved, regardless of what device, mechanism or process is used for tightening. Once locked in position, the device can be removed, the free end rolled up and stored, and the container is then ready for receiving the bulk cargo.

While the facing holes have been discussed as one example of a strap engagement system, other ways to hold the two straps together after tensioning could be used, for example, such as the use of a buckling device, to buckle the straps together, or where a projection such as a sloped tooth which extends from one strap and slides along in the direction of tensioning, then when tension begins to be released, the tooth locks into an opening on the opposed strap. Of course, multiple teeth could be used. Pulling again on the strap will dislodge the tooth from the opening, and allow the straps to be separated.

In another embodiment, a ratchet type tensioning device can be anchored at the bottom corner 6 of FIG. 1 which is adapted to engage the strap end so as to enable tensioning with a single tensioning device that optionally can remains in place after tensioning and locking of the straps is completed. A similar single tensioning device can be used with the embodiment of FIG. 3, anchored at the corner 9, again, which can optionally remain in place or be removed after the straps are locked together.

Optionally, an actual metal ring member can be located and may be attached to a panel in a central part thereof at a position where the apex 7 is shown, as opposed to simply forming a strap loop. The metal ring may reduce friction between the strap 8 and the strap 2 and/or parts of the strap 8 that crossover each other during tensioning, and also provide another attachment point for other straps or devices. Thus, friction from strap 8 rubbing on lower strap 2 may be reduced by such a ring being provided in the shape of a ring torus with smooth surfaces. To further reduce strap-on-strap friction, an n-fold (n-holed) torus could be used with the value of "n" depending on how many times the strap 8 is to be threaded through the central area. For instance, a triple torus (that would resemble three doughnuts stuck side by side) could be used for the embodiment of FIG. 1 and a double torus (two doughnuts resembling a figure eight) for the embodiment of FIG. 3. Referring to both FIGS. 1 and 3, according to an embodiment, a method is provided. According to the method, the lower strap may or may not be present and so only a ring will be described. The ring need not be attached to the panel or to a lower strap and may in fact be loose although it will end up being located in a central position of the door opening of the container and also centrally located relative to the end panel of the insert. Although the methodology described below uses the terms upper and lower with respect to corners, and upwardly and downwardly with respect to directions, it should be realized that these terms are used merely to help the reader in understanding the description of the method as applied to the improved end panels of FIGS. 1 and 3.

The method includes a first step of extending a strap 8 locked to a first upper corner cargo ring 9 of a container downwardly in a diagonal direction to a ring 7 centrally positioned in a door opening of the container and threading the strap through the central ring. A second step includes extending the strap upwardly in a diagonal direction to a second upper corner cargo ring 10 of the container and threading the strap through the second upper corner cargo ring. A third step includes extending the strap downwardly in a diagonal direction (opposite to the direction in the second step) to the central ring and threading the strap through the central ring. A fourth step involves extending the strap upwardly in a diagonal direction (opposite to the direction in the first step) to the first upper corner ring and threading the strap through the first upper corner ring. So far, the steps according to the inventive method are the same for use with the improved panel embodiments of both FIGS. 1 and 3.

For FIG. 1 however the method then includes extending the strap downwardly in a diagonal direction (in the same direction as in the first step) to the central ring, threading the strap through the central ring, extending the strap downwardly in a diagonal direction (in the same direction as in the first step) to a bottom corner cargo ring 6, and threading the strap through the bottom corner cargo ring. The method further includes pulling on the strap threaded through the bottom corner cargo ring to a selected tension and then fixing the selected tension by locking the strap in place with a locking device that locks one diagonally extended part of the strap to a facing diagonally extended part of the strap, e.g. in between the central ring 7 and the first upper corner ring 9.

In contrast, for FIG. 3, the method instead includes extending the strap downwardly in a vertical direction to a bottom corner cargo ring 5, threading the strap through the bottom corner cargo ring, extending the strap upwardly in the vertical direction to the first upper corner ring 9, threading the strap through the first upper corner cargo ring, pulling on the strap threaded through the first upper corner cargo ring to a selected tension and then fixing the selected tension by locking the strap in place for instance with a locking device that locks one vertically extended part of the strap to a facing vertically extended part of the strap.

As explained, the pulling may be carried out by a powered machine, by a hand operated winch with a ratchet or by manpower.

The central ring may be loose but, in the alternative, may be attached to an end panel of a flexible liner or insert, not necessarily in a central part as other positioning may be envisioned. One such position could for instance be a lower central part. In either event, the selected tension minimizes outward bulging adjacent the door opening of the container when the container is filed with a bulk cargo.

As explained before, the strap may be provided with holes at intervals along selected portions of the strap that will face one another after the pulling to a selected tension and the locking comprises clasping two facing holes together with a clasping device.

Figure 5:
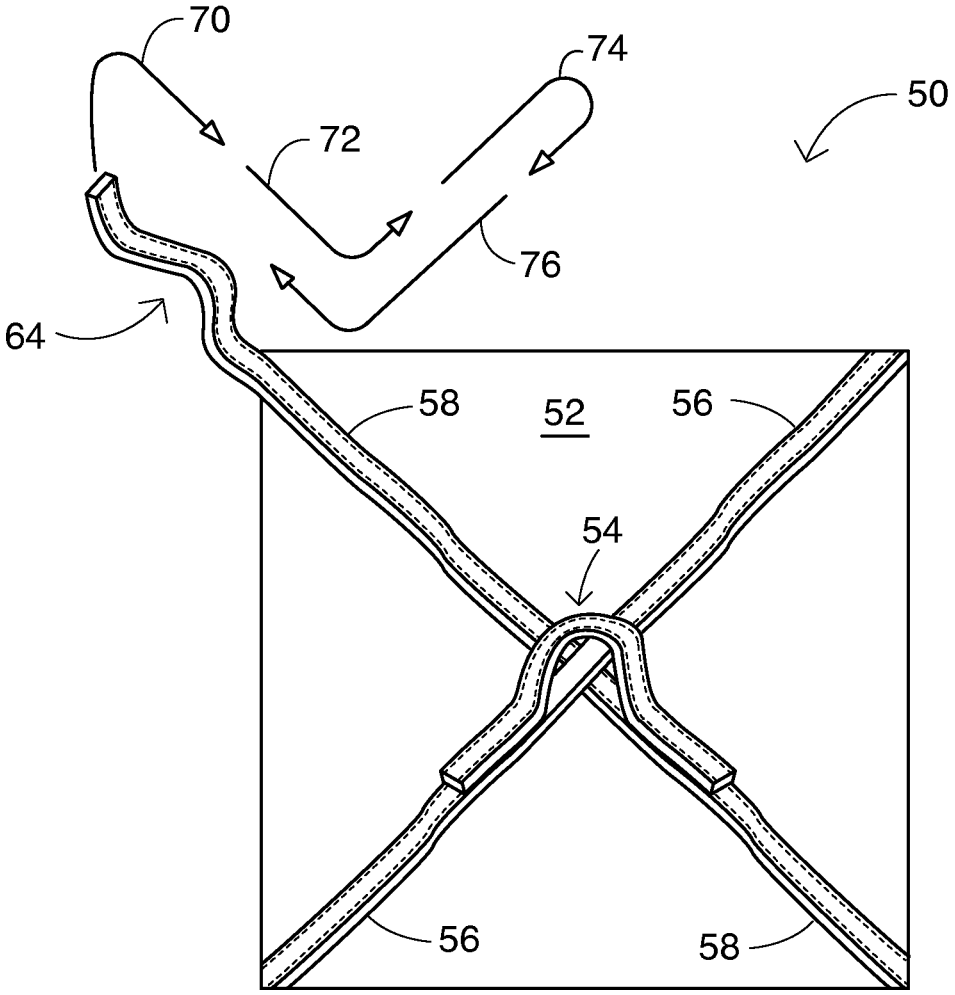
FIG. 5 shows a third embodiment of an improved end panel, according to the present invention.

FIG. 5 shows a modified end panel 50, according to an embodiment. It includes an end panel 52 and a pull ring 54 attached to the end panel 52 and positioned as a central ring in a central part of the panel 52. The end panel may be rectangular or square in shape with diagonal straps 56, 58 sewn crisscrossed into the panel 52 so that the straps crossover in the central area of the panel. The straps 56, 58 may be fully sewn to the front panel or may be attached by other means such as rivets or other permanent mechanical fasteners to form a pair of diagonally intersecting straps each extending from one corner of the panel to another diagonally opposite corner. The ring 54 may be a strap sewn to crisscrossing bottom portions of straps 56, 58 with a central part thereof loose to form the ring located in the central part of the panel 52. Alternatively, the ring may take a form other than a strap such as but not limited to at least one circular metallic ring or other integral ring having another shape or made of a non-metallic material attached for instance with a leather or fabric loop sewn or otherwise attached to the central area of the panel 52. One of the crisscrossing straps such as strap 58 should be longer than the other strap 56 so as to extend beyond the panel 52 as shown by an extension part 64 of the strap 58 forming a loose (unsewn) continuation thereof.

Figure 6:
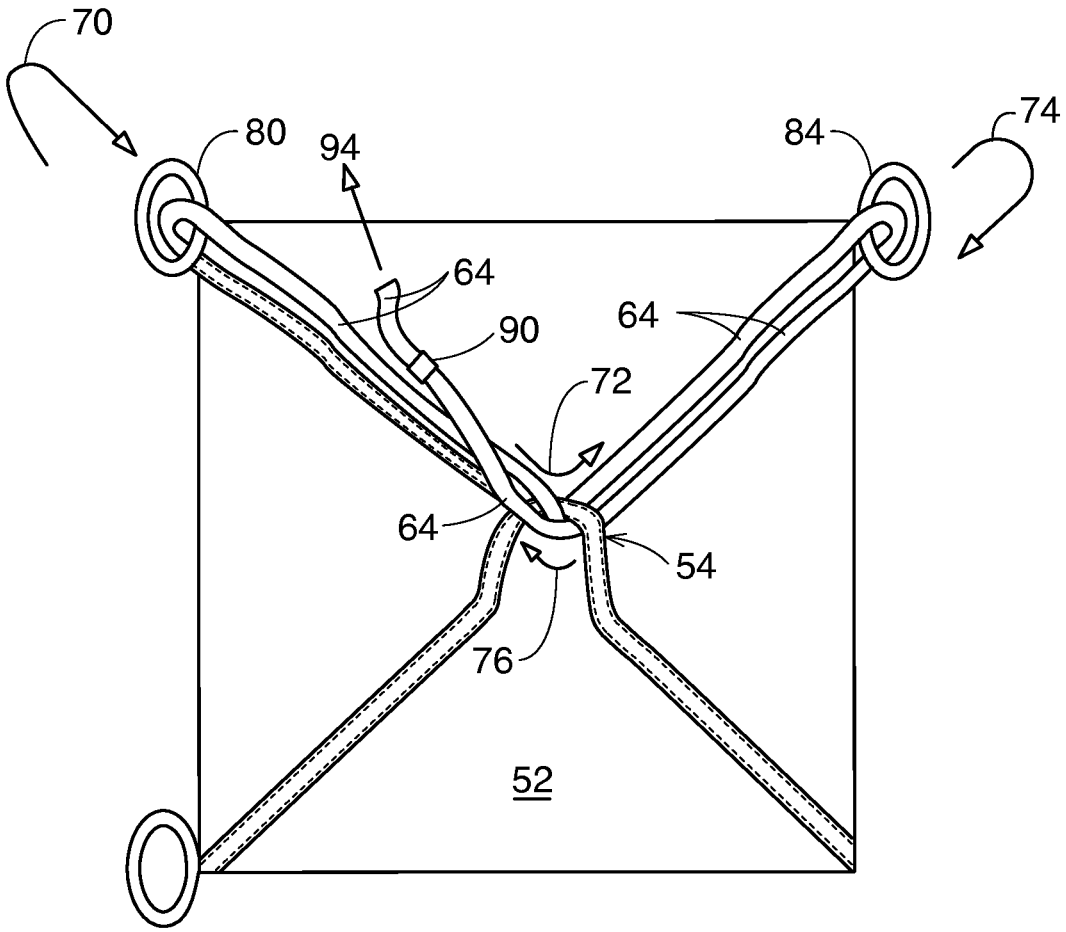
FIG. 6 shows a method utilizing the embodiment of FIG. 5, according to the present invention.

To the top left of FIG. 5 a series of threading operations 70, 72, 74, 76 are shown in the abstract for threading the extension part 64 of strap 58 through two cargo rings of the shipping container that are located in top container door corners near the upper corners of the panel 52. These threading operations are concretely illustrated as part of the lashing and tensioning method shown in FIG. 6. It should be realized that some of the details of FIG. 5 are omitted for clarity. First, the extension part 64 of strap 58 is threaded 70 through a first top door corner cargo ring 80 and extended diagonally downward toward the central area of the panel. There it is threaded 72 through the central ring 54 and extended diagonally upward toward a second top door corner cargo ring 84. Then the extension part 64 is threaded 74 through the second top door corner ring 84 and extended diagonally downward to the central area of the panel where it is threaded 76 through the central ring 54 and extended diagonally upward to engagement with a fastener 90 located for instance midway between the central ring 54 and the first top door corner cargo ring 80. The fastener 90 is shown in the abstract and may take various forms. For instance, it may take the form of a ratcheting buckle or clasp that has a permanently attached strap at one end extending up to the cargo ring 80 where it is tied down, hooked, or otherwise connected. The extension part may in that case be threaded through the other end of the fastener and the hilt of the ratcheting device is repeatedly driven to achieve the desired tension. A ratcheting device of that type is shown for instance in U.S. Pat. No. 6,662,962 at col. 6, line 62. Alternatively, a self-contained ratchet device (so-called "ratchet straps" (not shown)) with hooked straps attached to each end could be hooked at one end to the cargo ring 80 and at the other end to a hole (not shown) in the extension part 64. The hole may be a reinforced hole with a metallic ring around the circumference of the hole. Or, if a ratcheting device is not used, the extension part 64 of the strap 58 may be tensioned by pulling in a direction diagonally upward e.g. more or less toward the ring 80 such as generally shown by a reference numeral 94. The tensioning may be done by a machine or by other means such as described for the other embodiments. Alternatively, the fastening of the strap extension 64 may be done such as previously explained above in the other embodiments. In such cases the fastener 90 could be a metallic or strap ring such as shown in FIGS. 2 and 4 inserted through two aligned holes in the extension part 64 between the cargo ring 80 and the central ring 54.

With reference to FIG. 5, it should be understood that the extension part 64 may be formed differently than shown. For instance, instead of being an extension of strap 58, it may take the form of a third strap (not shown) attached or attachable to one of the corners of the panel, When attached, it extends beyond the one corner that it is attached to. Or, another strap (not shown) may be provided loose and attachable to either a shortened extension strap 64 or to a shortened third strap as just described.

The invention claimed is:

1. A modified end panel for a flexible liner or insert to minimize outward bulging adjacent a container end door when the container is filled with a bulk cargo by strapping the end panel, comprising:

an end panel;

a strap sewn or otherwise attached to at least a first bottom corner of the end panel of the flexible liner or insert and extending or at least extendable from the first bottom corner of the end panel diagonally up to a middle area of the end panel and down to a second bottom corner where the strap is at least sewn or otherwise attached to the second bottom corner, forming a triangle with an unsewn or unattached top apex forming an opening that acts as a central ring; and a single strap having a first end locked to a first upper corner ring of the container, extending diagonally downwardly through the central ring, then diagonally upwardly to an opposite side second upper corner ring of the container, passing therethrough and diagonally downwardly through the central ring and diagonally upwardly through the first upper corner ring, then in a final leg diagonally downwardly through the central ring and further downwardly through a bottom corner ring of the container positioned under the second upper corner ring with a second end of the strap passing through the bottom corner ring and being engageable by a removable tensioning device, wherein portions of the single strap that extend upwardly and downwardly relative to the first upper corner ring have a plurality of linearly arranged openings, such that once the strap is tensioned by the removable tensioning device, a locking device is passed through at least one facing pair of openings, for maintaining the strap in tensioned condition, after the removable tensioning device is removed.

2. The modified end panel of claim 1, wherein the single strap, in the final leg passes instead of through the central ring, straight downwardly through the bottom ring located below the first upper corner ring, then back upwardly through the first upper ring, the free end then engaged by the removable tensioning device, the facing portions on the strap passing between the first upper corned ring and bottom corner ring having the plurality of facing holes so as to permit locking of the strap, after tensioning along the side, rather than in the middle, of the end panel.

3. A modified end panel, comprising:

an end panel for insertion in a shipping container in a door opening of the shipping container;

a pull ring attached to the end panel positioned as a central pull ring that when pulled by tensioning straps causes the end panel to push back against bulging of the end panel by cargo in the container abutting the end panel and pushing against the end panel from inside the container; and a single strap having a first end locked to a first upper corner ring of the container, extending diagonally downwardly through the central pull ring, then diagonally upwardly to an opposite side second upper corner ring of the container, passing therethrough and diagonally downwardly through the central pull ring and diagonally upwardly through the first upper corner ring, then in a final leg diagonally downwardly through the central pull ring and further downwardly through a bottom corner ring of the container positioned under the second upper corner ring with a second end of the strap passing through the bottom corner ring and being engageable by a removable tensioning device, wherein portions of the single strap that extend upwardly and downwardly relative to the first upper corner ring have a plurality of linearly arranged openings, such that once the strap is tensioned by the removable tensioning device, a locking device is passed through at least one facing pair of openings, for maintaining the strap in tensioned condition, after the removable tensioning device is removed.

4. The modified end panel of claim 3, wherein the single strap, in the final leg passes instead of through the central pull ring, straight downwardly through the bottom ring located below the first upper corner ring, then back upwardly through the first upper ring, the free end then engaged by the mechanical tensioning means, the facing portions on the strap passing between the first upper corner ring and bottom corner ring having the plurality of facing holes so as to permit locking of the strap, after tensioning along the side, rather than in the middle, of the end panel.

5. The modified end panel of claim 3, further comprising:

a first strap sewn or otherwise attached to the panel and extending between a first pair of diagonally opposite corners of the panel wherein an extension part of the first strap is provided loose and extending beyond one corner of the first pair of diagonally opposite corners of the panel; and a second strap sewn or otherwise attached to the panel and extending between a second pair of diagonally opposite corners of the panel so as to crisscross the first strap in a central area of the panel, wherein the central pull ring is attached to the end panel where the first strap crisscrosses the second strap.

6. The modified end panel of claim 3, further comprising:

a first strap sewn or otherwise attached to the panel and extending between a first pair of diagonally opposite corners of the panel:

a second strap sewn or otherwise attached to the panel and extending between a second pair of diagonally opposite corners of the panel so as to crisscross the first strap in a central area of the panel; and a third strap attachable to one of the corners of the panel, that when attached extends beyond the one corner that is attached to, wherein the central pull ring is attached to the end panel where the first strap crisscrosses the second strap.

7. The modified end panel of claim 6, further comprising a fourth strap provided loose and attachable to the third strap.

8. The modified end panel of claim 3, wherein after tensioning, the tension is maintained by a metallic locking device.

9. The modified end panel of claim 3, wherein the tensioning is carried out by locking a same strap in opposite tensioning directions.

10. The modified end panel of claim 3, wherein tensioning is carried out by tension applied by a ratchet device connected between the loose strap and another strap attached to a container cargo ring and the tension is lockable by the ratchet device.

11. A modified end panel, comprising:

an end panel for insertion in a shipping container in a door opening of the shipping container;

a pull ring attached to the end panel positioned as a central pull ring that when pulled by tensioning straps causes the end panel to push back against bulging of the end panel by cargo in the container abutting the end panel and pushing against the end panel from inside the container, a first strap sewn or otherwise attached to the panel and extending between a first pair of diagonally opposite corners of the panel;

a second strap sewn or otherwise attached to the panel and extending between a second pair of diagonally opposite corners of the panel so as to crisscross the first strap in a central area of the panel; and a third strap attachable to one of the corners of the panel, that when attached extends beyond the one corner that it is attached to, wherein the central pull ring is attached to the end panel where the first strap crisscrosses the second strap, and wherein the third strap is threadable through a first container cargo ring and is extendable downwardly to the pull ring and upwardly to a second container cargo ring and back in a reverse move for further tensioning and securement with one of the previous extensions of the third strap.

12. A modified end panel, comprising:

an end panel for insertion in a shipping container in a door opening of the shipping container;

a pull ring attached to the end panel positioned as a central pull ring that when pulled by tensioning straps causes the end panel to push back against bulging of the end panel by cargo in the container abutting the end panel and pushing against the end panel from inside the container, a first strap sewn or otherwise attached to the panel and extending between a first pair of diagonally opposite corners of the panel:

a second strap sewn or otherwise attached to the panel and extending between a second pair of diagonally opposite corners of the panel so as to crisscross the first strap in a central area of the panel; and a third strap attachable to one of the corners of the panel, that when attached extends beyond the one corner that it is attached to, wherein the central pull ring is attached to the end panel where the first strap crisscrosses the second strap, and wherein the third strap is threadable through a first container cargo ring and extendable in a first segment diagonally downwardly to and threadable through the pull ring, diagonally upwardly in a second segment to a second cargo ring and threadable through the second cargo ring, diagonally downwardly in a third segment to and threadable through the pull ring, diagonally upwardly in a fourth segment toward the first cargo ring and tensionable toward the first cargo ring, the fourth segment securable to the first segment under tension with a locking device.

* * * * *